US005971086A

United States Patent [19]

Bee et al.

[11] Patent Number: 5,971,086

[45] Date of Patent: Oct. 26, 1999

[54] PIPE GRIPPING DIE

[75] Inventors: Robert M. Bee; William Ty Livingston, both of Lafayette, La.

[73] Assignee: Robert M. Bee, Lafayette, La.

[21] Appl. No.: 08/912,220

[22] Filed: Aug. 15, 1997

Related U.S. Application Data

[60] Provisional application No. 60/024,325, Aug. 19, 1996.

[51] Int. Cl.[6] ..... E21B 19/07; E21B 19/10

[52] U.S. Cl. ..... 175/423; 166/75.14; 166/382; 188/67; 294/102.2; 294/902

[58] Field of Search ..... 175/423; 166/382, 166/75.14, 243; 294/1.1, 102.1, 102.2, 902; 188/67

[56] References Cited

U.S. PATENT DOCUMENTS

| | | | |
|---|---|---|---|
| 2,010,938 | 8/1935 | Abegg | 175/423 |
| 2,493,556 | 1/1950 | Stone | 175/423 |
| 3,052,943 | 9/1962 | Jones | 188/67 |
| 4,475,607 | 10/1984 | Haney | 175/423 |
| 4,715,456 | 12/1987 | Poe, Jr. et al. | 175/423 |
| 5,451,084 | 9/1995 | Jansch | 294/1.1 |

*Primary Examiner*—Hoang C. Dang
*Attorney, Agent, or Firm*—Robert N. Montgomery

[57] ABSTRACT

A method for the construction of die members used in slips and elevators in the oil and gas industry for griping pipe. The die having nickel plated teeth with no mud grooves reduces die penetration thereby reducing stress cracking and carbon transfer in nickel alloy pipe thus reducing pipe corrosion.

12 Claims, 1 Drawing Sheet

PIPE GRIPPING DIE

This application claims benefit of U.S. provisional application 60/024,325 filed Aug. 19, 1996.

FIELD OF THE INVENTION

The present invention relates to pipe slips and elevators in general and more particular to the gripping dies used in such slips and elevators.

GENERAL BACKGROUND

Slips and elevators used primarily for lifting tubular goods, such as drill pipe or production tubing and the like, generally comprise a plurality of circumferentially spaced slip bodies called dies which are held collectively in a body which surrounds the locus of the drill pipe body and when used as slips the die body is in turn captured and held by a body known as a bowl. By means well known within the art, the device can be manipulated into position about the circumference of a length of pipe in a manner whereby the inner sides of the dies, having hardened metal gripping teeth, bite into and frictionally engaging the pipe body when the weight of the pipe is applied. The slip body retains the dies in place and allows the dies to have some degree of freedom with respect to the slip or elevator body, thereby allowing conformity with the pipe body. The dies are further contoured to generally conform to the curvature of the pipe body. Such slip and elevator dies are also available with various tooth configurations which help grip the pipe. Such configurations include mud grooves which allow the pipe dies to maintain a grip even in contaminated conditions, such as when the pipe is coated with mud and oil. However, it is well known in the art that damage to the pipe occurs when the dies wear unevenly or when the die teeth become damaged producing jagged edges, in which case stress risers may be set up in the surface of pipe which may result in premature pipe failure. The accepted method of gripping pipe in this manner depends on the ability of the die teeth to penetrate the surface of the pipe to some degree rather than apply excessive force which may crush or misshape the pipe.

The problem is compounded when such dies are used on high chromium pipe. Chromium or other nickel alloy pipe is often used in highly corrosive wells such as Hydrogen Sulfide ($H_2s$) gas wells. Such pipe is expensive and must be handled carefully to avoid damage to the chromium surface which attract corrosion, thereby leading to early failure. Therefore, a new and better means of handling such chromium and nickel alloy pipe is required in order to prevent damaging the chromium pipe surfaces. A problem also exists, when the hardened, high carbon, steel teeth on the dies make contact with the chromium or nickel alloyed pipe, thereby transferring small amounts of carbon to the pipe at each penetration point. Such carbon transfer spots have been found to set up sites for corrosion which lead to stress cracks in the pipe. It has been found that carbon creates galvanic action, thereby hardening pipe in the same manner as hydrogen sulfide, causing brittleness of the metal. Tests on chrome pipe with salt spray have shown that any discontinuity in the surface of the pipe causes a deterioration of between 0.011–0.015 loss in pipe wall thickness per year. For example, a number 13 chrome pipe having 0.217 wall thickness with a 0.028 penetration coupled with 0.015 corrosion factor per year accelerates corrosion deterioration exponentially.

Others in the art have attempted to address the problem of handling chromium pipe to and to reduce penetration, such as that disclosed by U.S. Pat. No. 5,451,084 wherein strips having hard teeth which get progressively softer along its length are held in a resilient base to allow flexibility. However such structures fail to address the problem of sharp tooth edges resulting from mud grooves cut vertically through the tooth configuration and the problem of carbon transfer to the pipe body.

Slip elevator and tong dies all rely on the biting action of the die's teeth into the pipe body for griping the pipe. However, recently the industry has begun addressing these problems by attempting to reduce stress induced into the surface of the pipe through better fits, flexible die seats, etc. However, to date, such dies still generally produce penetrations of between 0.017–0.028 of an inch with pipe loads of 14000 ft. with up to 100% carbon transfer. Test show that such high carbon deposits in the penetrations of pipe used in high corrosive wells last only a few weeks. In any case, the industry still considers die penetration of the surface of the pipe necessary. However, it is becoming essential that such penetration by the die teeth into the pipe body must be kept to a minimum, generally in the order of less than 0.002/1000 of an inch.

SUMMARY OF THE PRESENT INVENTION

The present invention addresses the issues raised by the above discussion. Since it has been established that pipe dies generally must penetrate the surface of the pipe in order to maintain a positive grip and thus avoid crushing the pipe, and it is essential that this penetration be kept to a minimum, the concept of the present invention is therefore to provide dies which have a minimum number of teeth corners or edges, which tend to break and/or dig into the pipe body, make minimum penetration and provide a hard, non-carbon coating over the die teeth which will prevent carbon transfer to chromium or other such nickel alloy pipe.

It is therefore an object of the invention to provide a pipe die having the ability to grip a pipe with a minimum penetration of less than 0.002/1000 of an inch without leaving carbon deposits in such penetrations.

It is still a further object of the invention to provide a pipe die having a minimum number of sharp edges which could cause cuts or otherwise mark the surface of a chromium or nickel alloy pipe body.

BRIEF DESCRIPTION OF THE DRAWINGS

For a further understanding of the nature and objects of the present invention, reference should be made to the following detailed description, taken in conjunction with the accompanying drawings, in which like parts are given like reference numerals, and wherein.

DESCRIPTION OF THE PREFERRED EMBODIMENT

Figure 1:
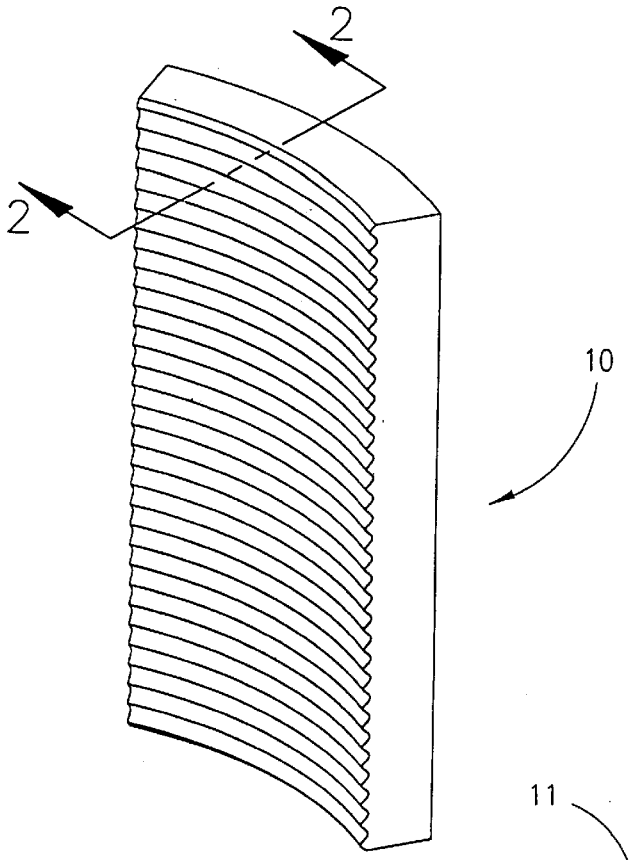
FIG. 1 is an isometric view of the present invention.
Figure 2:
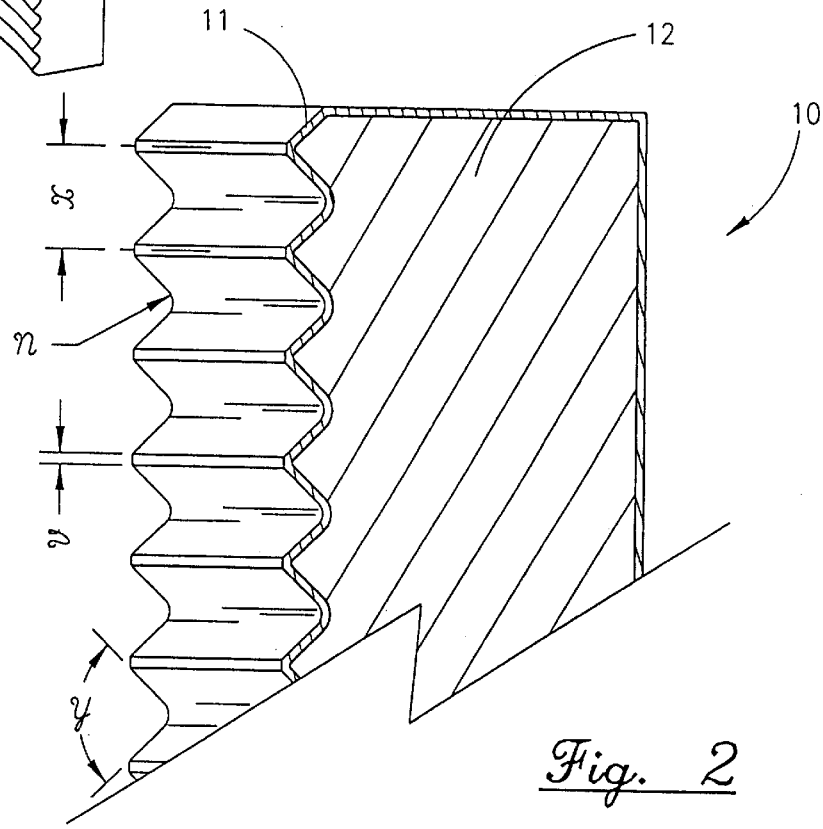
FIG. 2 is a partial cross section view taken along sight lines 2—2 in FIG. 1.

As illustrated in FIG. 1, the present invention comprises a pipe die insert or segment 10 having a tooth profile as shown in FIG. 2. The die insert 10 usually one of several used cooperatively in pipe slips and elevators. The die insert, being generally configured in the same manner as that accepted as standard in the industry for such slips and elevators, comprises a die generally made from 8620 or 1018 steel 12, case hardened to a depth of 0.030 to 0.035 thousandths of an inch, and an optimum of eight teeth per inch. Departing from such standard practice, the present invention provides a larger tooth radius illustrated in FIG. 2 by diameter dimension υ, shown at the tooth tips, larger tooth root radius η, no mud grooves and a special coating 11. The tooth profile is a 90 degree included angle Y, a tooth, tip radius of 0.030–35 thousandths of an inch, a tooth root radius η of 0.005 thousandths of an inch, and a center to center distance between the teeth X of 0.125 thousandths of an inch. The special coating 11 is a 0.0002 to 0.0007 thick coating of hard chrome or electroless nickel in solution, chemically disposed by ionic transfer, furnished by Gull Industries under the trade name of GULLITE-CHROMIUM™. This process provides a thin, very adherent, high quality, dense chromium deposit. The deposit is ideally suited to configurations such as threads and splines where conventional platings are not practical. The coating exhibits very high degree of hardness and withstands high temperatures. This coating has proven to achieve superior corrosion and wear characteristics when used in corrosive atmospheres. It has also exhibited excellent resistance against chipping, cracking or separation from the base material.

The larger tooth tip radius and the plating reduces the tooth penetration drastically. Tests have shown that up to 14000 ft of chromium pipe can be held successfully with the instant die 10 with virtually no pipe marking and only 0.0005/1000 penetration with 17000 ft . of pipe. Such test have also shown a loss of contact area on the dies of less than 5% after running 17000 ft of pipe and effecting a carbon transfer of only 1% of the contact surface area at 18,500 ft. of pipe. Therefore, a 0.0005/1000 penetration and carbon transfer rate 1% drastically reduces the rate of corrosion and possibility of stress cracking leading to pipe failure Testing has also indicated that the handling of pipe die slips and elevators plays an important role in the degree of damage done to the surface of pipe. Workers tend to allow the slip tool bowl to close the slips which causes a great deal of slip scarring on the pipe. However, if the slips are handled correctly and closed completely before positioning in the slip bowl the present dies 10 leave little or no penetration and very little carbon transfer on the pipe surface. By eliminating mud grooves generally used on dies in the prior art, the present die 10 has fewer corners thereby reducing the number of stress points which may cause damage to the dies 10. A further benefit has been found by using the present die 10. After each pipe run the slip dies are often replaced and the dies returned to the manufacturer for inspection and replacement or refurbishing. A great deal of time is expended in sand blasting the dies prior to inspection. It has been found that the sand blasting process, which often hides surface stress cracks, is not necessary when the dies 10 are plated 11 and can be easily cleaned with solvent prior to inspection thus reducing labor and cost. Since the plating process 11 reduces the stress on the dies and the die suffers less damage due to a reduced number of corners the dies 10 consistently last longer, thereby further reducing cost.

The present invention therefore extends the art by proving that the need for deep penetration is not necessary and that carbon transfer can be prevented, thus increasing pipe life and reducing cost associated with slip and elevator dies.

Because many varying and different embodiments may be made within the scope of the inventive concept herein taught and because many modifications may be made in the embodiments herein detailed in accordance with the descriptive requirement of the law, it is to be understood that the details herein are to be interpreted as illustrative and not intended to limit the invention.

What is claimed is:

1. A pipe die insert of the type generally used with pipe slips and elevators in oil and gas drilling operations, the die comprising:

i) an elongated steel die member having a concave face relative a longitudinal axis;

ii) a plurality of arcuate, anticline teeth juxtaposed along said concave face and running transversely to said longitudinal axis; and iii) a hard chrome plating applied to said teeth.

2. A pipe die according to claim 1 wherein said die comprises eight teeth per inch of said steel die member.

3. A pipe die according to claim 1 wherein said teeth are uninterrupted across said concave face.

4. A pipe die according to claim 1 wherein said hard chrome plating is an electroless nickel plating process having a thickness of between 0.0001 and 0.0004.

5. A pipe die according to claim 1 wherein said hard chrome plating is an electroless nickel plating process having an equivalent hardness in excess of 70 Rockwell "C".

6. A pipe die according to claim 1 wherein said hard chrome plating is an electroless nickel plating process having a high resistance to hydrogen sulfide.

7. A pipe die insert of the type generally use with pipe slips and elevators in oil and gas drilling operations, the die comprising:

a) an elongated steel die member having a concave face along a longitudinal axis;

b) a plurality of arcuate, anticline teeth juxtaposed along said concave face and running transversely to said longitudinal axis, said die member having eight teeth per linear inch of die member with said teeth having a 90 degree included root angle and a center to center tooth spacing of 0.125 on an inch; and c) a hard chrome electroless plating applied to said teeth having a thickness of 0.0001–0.0002 of an inch with a hardness in excess of 70 Rockwell "C".

8. A method of retaining a string of nickel alloy drill pipe in a bore hole comprising the steps of:

a) replacing a compatible set of die inserts, in a slip-type gripping assembly commonly used for griping said string of nickel alloy drill pipe, with a replacement set of dies comprising:

i) an elongated steel die member having a concave face along a longitudinal axis;

ii) a plurality of arcuate, anticline teeth juxtaposed along said concave face and running transversely to said longitudinal axis, said die member having eight teeth per liner inch of die member with said teeth having a 90 degree included root angle and a center to center tooth spacing of 0.125 on an inch; and iii) a hard chrome electroless plating applied to said teeth having a thickness of 0.0001–0.0002 of an inch with a hardness in excess of 70 Rockwell "C"; and b) utilizing said griping assembly and said replacement set of dies to retain said string of nickel alloy drill pipe in a bore hole with a pipe die penetration of said drill pipe less than 0.002 thousandths of an inch.

9. The method according to claim 8 including the step of repetitiously engaging a suspended string of said nickel alloy pipe, up to 17000 feet in length, with said dies without transferring carbon from said dies to said pipe.

10. The method according to claim 8 includes the step of engaging a suspended string of said nickel alloy pipe with said dies produces a carbon transfer rate of between 1–2% of the contact surface between said dies and said pipe with a suspended pipe string of 18,500 feet in length.

11. A method for reducing cost of inspection and increasing useful longevity of pipe slip dies comprising the steps of;

a) providing an elongated steel pipe slip die member having a concave face relative its central longitudinal axis, said concave face having a plurality of arcuate, anticline teeth juxtaposed along said concave face and running transversely to said longitudinal axis; and b) applying hard chrome plating to said pipe slip die member.

12. The method according to claim 11 further includes the step of deburring said pipe slip die member, leaving said pipe slip die member without any sharp edges.

* * * * *